US007736151B1

(12) United States Patent
Yang

(10) Patent No.: US 7,736,151 B1
(45) Date of Patent: Jun. 15, 2010

(54) ELECTRICAL CONNECTOR FOR A KITCHEN APPLIANCE

(75) Inventor: Weiqun Yang, Shenzhen (CN)

(73) Assignee: Hamilton Beach Brands, Inc., Glen Allen, VA (US)

( * ) Notice: Subject to any disclaimer, the term of this patent is extended or adjusted under 35 U.S.C. 154(b) by 0 days.

(21) Appl. No.: 12/407,330

(22) Filed: Mar. 19, 2009

(51) Int. Cl.
*H01R 11/30* (2006.01)

(52) U.S. Cl. ..... 439/39; 439/40; 219/494; 219/491

(58) Field of Classification Search ..... 439/38, 439/39, 40; 219/429, 432, 435, 481, 491, 219/494, 518; 99/325
See application file for complete search history.

(56) References Cited

U.S. PATENT DOCUMENTS

| | | | | |
|---|---|---|---|---|
| 2,573,920 | A * | 11/1951 | McLeod | 200/51.09 |
| 4,317,969 | A | 3/1982 | Riegler et al. | |
| 4,874,316 | A | 10/1989 | Kamon et al. | |
| 6,183,264 | B1 | 2/2001 | Harsanyi et al. | |
| 6,267,602 | B1 | 7/2001 | Mendelson et al. | |
| 6,478,614 | B1 | 11/2002 | De'Longhi | |
| 6,527,570 | B1 | 3/2003 | Hartman et al. | |
| 6,607,391 | B2 | 8/2003 | Mendelson et al. | |
| 6,623,276 | B2 | 9/2003 | Dalmau Ferrerfabrega et al. | |
| 6,719,576 | B2 * | 4/2004 | Hartman et al. | 439/180 |
| 6,966,781 | B1 * | 11/2005 | Bullinger et al. | 439/38 |
| 7,329,128 | B1 * | 2/2008 | Awad et al. | 439/38 |
| 7,467,948 | B2 * | 12/2008 | Lindberg et al. | 439/38 |
| 2004/0077187 | A1 | 4/2004 | Belongia et al. | |
| 2006/0114087 | A1 | 6/2006 | Deng | |

* cited by examiner

*Primary Examiner*—Xuong M Chung-Trans
(74) *Attorney, Agent, or Firm*—Panitch Schwarze Belisario & Nadel LLP

(57) ABSTRACT

An electrical connector for a kitchen appliance includes a socket having at least one electrical contact and at least one metallic member. A plug having at least one electrical contact and a magnet which is movably positioned within the plug. A power cord is movably positioned within the plug and is operatively connected to the at least one electrical contact of the plug. An attractive force exists between the at least one metallic member and the magnet when the plug is engaged with the socket and the magnet is within a predetermined distance of the at least one metallic member. Movement of a leading end of the power cord toward a distal end of the plug moves the magnet toward the distal end of the plug to reduce a magnitude of the attractive force and permit the plug to be more easily removed from the socket.

16 Claims, 4 Drawing Sheets

ELECTRICAL CONNECTOR FOR A KITCHEN APPLIANCE

BACKGROUND OF THE INVENTION

The present invention is directed to a kitchen appliance for cooking foodstuff and, more particularly, to a deep fryer or other cooking apparatus that enables a user to quickly and conveniently operatively connect and/or disconnect a plug of a power cord to an electrical socket of the deep fryer to selectively provide power to and/or remove power from the deep fryer.

Deep fryers are a relatively common household or restaurant appliance that are used to cook or fry foodstuff, typically chicken breasts, turkey breasts, French fries or other foodstuff that is desired to be fried. A typical deep fryer includes a housing which holds cooking oil or other liquid to be heated, a basket which is placed inside the housing which holds the foodstuff to be cooked within the hot oil or other liquid and a lid mounted to the housing. A heating coil, located inside the deep fryer, heats the liquid to a desired temperature. A power cord operatively connects the heating coil to an electrical outlet to provide power to the heating coil.

When cooking is complete, the user desires to cut power to the deep fryer and dispose of the liquid within the deep fryer to eventually clean the deep fryer. To cut power to the deep fryer, the user often disconnects or removed the plug of the power cord from a socket of the deep fryer. However, in conventional deep fryers, the connection between the plug of the power cord and the socket of the deep fryer is relatively strong (typically a mechanical "interference fit") and, thus, requires a relatively high force to remove the power cord from the deep fryer. Therefore, in conventional deep fryers, it is not unusual for the user to inadvertently at least partially tip over the deep fryer while attempting to remove the plug of the power cord from the socket of the deep fryer. Tipping over the deep fryer can create an inconvenience to the user, as the user is left with spilled cooking oil or foodstuff to clean up.

Therefore, it would be desirable to create a deep fryer having a plug of the power cord that is easily removably attached to the deep fryer such that a relatively low force is required to remove the power cord from the deep fryer. Further, it would be desirable to create a deep fryer having a plug of the power cord that is easier to connect and/or disconnect from a socket of the deep flyer.

BRIEF SUMMARY OF THE INVENTION

Briefly stated, the present invention is directed to an electrical connector for a kitchen appliance. The connector includes a socket mounted to the appliance. The socket has at least one electrical contact and at least one metallic member. A plug has a proximal end and an opposite distal end. The proximal end of the plug has at least one electrical contact for operative engagement with the at least one electrical contact of the socket. A magnet, having a first end and an opposite second end, is movably positioned within the plug. A power cord, having a leading end and an opposite trailing end, is movably positioned within the plug and is operatively connected to the at least one electrical contact of the plug. The trailing end is operatively engagable with a power source. An attractive force exists between the at least one metallic member and the magnet when the plug is engaged with the socket and the magnet is within a predetermined distance of the at least one metallic member. Movement of the leading end of the power cord toward the distal end of the plug moves the magnet toward the distal end of the plug to reduce a magnitude of the attractive force and permit the plug to be more easily removed from the socket.

BRIEF DESCRIPTION OF THE SEVERAL VIEWS OF THE DRAWINGS

The foregoing summary, as well as the following detailed description of a preferred embodiment of the present invention, will be better understood when read in conjunction with the appended drawings. For the purpose of illustrating the invention described in the present application, there is shown in the drawings, an embodiment which is presently preferred. It should be understood, however, that the invention is not limited to the precise arrangements and instrumentalities shown. In the drawings.

DETAILED DESCRIPTION OF THE INVENTION

Figure 1:
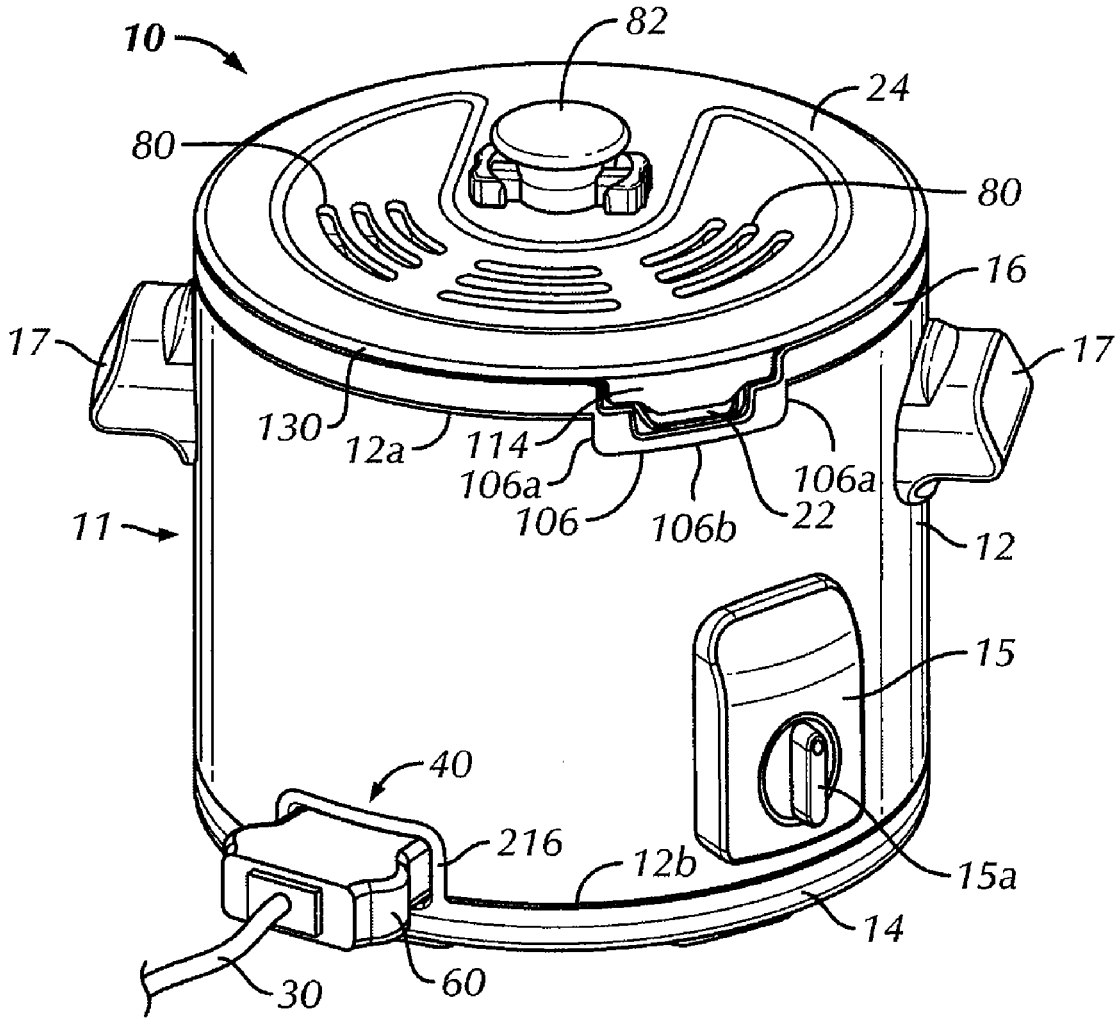
FIG. 1 is a front perspective view of a preferred embodiment of a deep fryer in accordance with the present invention.

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of the kitchen appliance and designated parts thereof. Additionally, the term "a," as used in the specification, means "at least one." The terminology includes the above-listed words, derivatives thereof and words of similar import.

Figure 2:
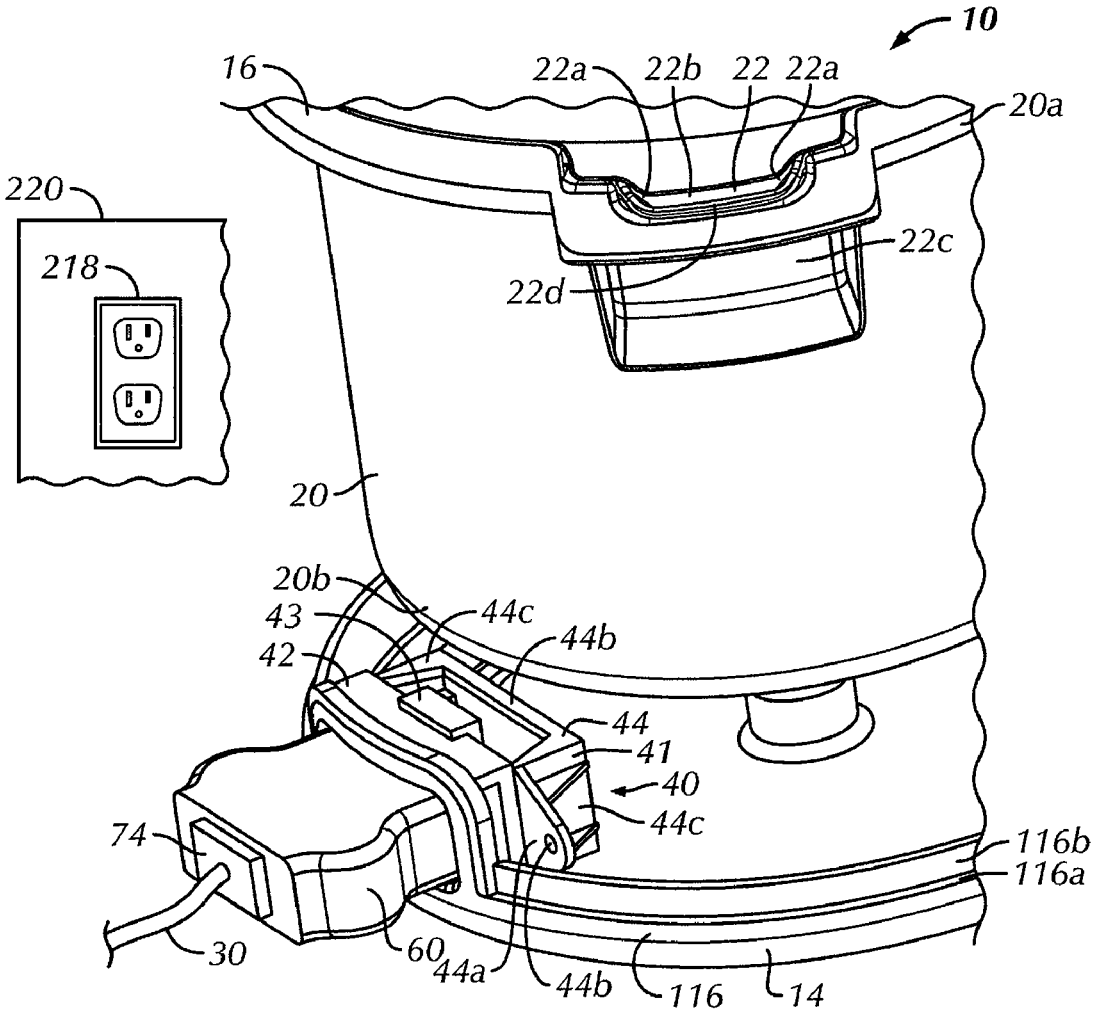
FIG. 2 is a partial view of an electrical outlet mounted within a wall and a partial perspective view of the deep fryer shown in FIG. 1, with an outer wrap or shell removed for clarity.

Referring now to the drawings in detail, wherein like numerals are used to indicate like elements throughout, there is shown in FIGS. 1 and 2 a presently preferred embodiment of a kitchen appliance, generally designated 10, for cooking foodstuff (not shown) in a liquid, such as cooking oil or the like (not shown). Preferably, the kitchen appliance 10 is a deep fryer, but the kitchen appliance 10 could be other product such as a crock pot or steamer machine, for example. The deep fryer 10 is a relatively small, light-weight and portable device, as compared to conventional deep fryers. The deep fryer 10 preferably includes a container 11 for receiving the foodstuff and the liquid and a lid 24 removably mountable to the container 11. The container 11 is preferably circular or cylindrical in shape and includes an upper, open end and a lower, closed end. A sidewall generally orthogonally extends from the lower, closed end and has an interior surface and an exterior surface. The lid 24 is removably mountable to the upper, open end of the container 11 to enclose the foodstuff and the liquid therein.

As seen in FIG. 1, the container 11 includes an outer shell or wrap 12 having an upper surface or rim 12*a* and a lower surface or rim 12*b*. The outer shell 12 has an exterior surface exposed to the external environment and an internal surface that is exposed to the interior of the deep fryer 10. The outer shell 12 is generally circular or cylindrical in shape and is preferably formed of a high strength, light weight material, such as a metallic material. The outer shell 12 is preferably a relatively thin layer or structure that encloses and protects the interior structure of the deep fryer 10. The outer shell 12 preferably includes a cut-out 106 adjacent to the upper surface 12*a* thereof. Specifically, the cut-out 106 is generally rectangular in shape when viewed from the side and has two spaced-apart, vertically extending, edge portions 106*a* that intersect an elongated, horizontally-extending, edge portion 106*b* that is spaced a predetermined distance below the upper rim 12*a* of the outer shell 12. Further, the deep fryer 10 includes at least one, but preferably two spaced-apart handles 17 permanently attached to opposing sides of the exterior surface of the outer shell 12. The handles 17 allow the user to control movement and placement of the deep fryer 10.

Referring again to FIG. 1, a control housing 15 is preferably permanently mounted to the exterior surface of the outer shell 12. In the preferred embodiment, the control housing 15 includes a rotatable dial 15*a* that allows the user to selectively control and/or adjust an adjustable thermostat (not shown) enclosed within the deep fryer 10. The deep fryer 10 may include a fixed temperature thermostat (not shown) in series with the adjustable thermostat to regulate the temperature in an alternative manner. It is understood by those skilled in the art that the deep fryer 10 may include both or only one of the thermostats. The control housing 15 may include a timer knob (not shown) and/or a power switch (not shown). A consumer or user can selectively control a heating element (not shown), such as a CalRod, by adjustment of the thermostat through manipulation of the dial 15*a*. Alternatively, the control housing 15 may include one or more buttons, levers or knobs (not shown) that allow the user to control operation of the heating element. Furthermore, the deep fryer 10 is not limited to the inclusion of a control housing 15, or the control housing 15 may be positioned inside the deep fryer 10.

As seen in FIGS. 1 and 2, an electrical connector 40 is mounted to the outer wrap 12 and operatively connects the thermostat(s) and heating element to an electrical power source, such as an electrical outlet 218 mounted on a wall 220. The electrical connector 40 includes a socket 41, which at least partially encloses at least one but preferably two spaced-apart electrical contacts 42*a*, 42*b* located therein, and a plug 60 removably mountable to the socket 41. A power cord 30 extends from the plug 60 and operatively engages the electrical power source, such as the electrical outlet 218. As described in detail below, portions of the plug 60 engage the electrical contacts 42*a*, 42*b* of the socket 41, which allows the user to selectively provide and cut power to the deep fryer 10. The socket 41 is preferably oriented such that the plug 60 must be substantially horizontally oriented, with respect to a supporting surface, such as a countertop, to operatively connect to the deep fryer 10 to the power source. Further, the socket 41 and plug 60 are preferably magnetically connected, thus reducing the force required to separate the plug 60 from the socket 41. The magnetic connection between the socket 41 and plug 60 create a break-away electrical connection that can be relatively easily disengaged to prevent the deep fryer 10 from inadvertently tipping when the plug 60 is removed from the socket 41.

Referring again to FIGS. 1 and 2, the container 11 includes a base 14 at the lower or bottom end thereof. Specifically, the base 14 engages and/or encloses the lower rim 12*b* of the outer shell 12. The base 14 is generally circular or cylindrical in shape and is sized and shaped to conform to and/or generally tightly fit within or around the lower surface 12*b* of the outer shell 12. Specifically, as seen in FIG. 2, the base 14 includes a vertically-extending sidewall 116 having a lip or horizontally-extending edge portion 116*a* that extends around the outer circumference of the base 14 proximate a vertical midsection thereof. An upper, free end 116*b* of the sidewall 116 is slightly recessed with respect to the portion of the sidewall 116 that is beneath the lip 116*a*, such that the lower rim 12*b* engages and/or sits on the lip 116*a*. A plurality of spaced-apart protrusions (not shown) may extend from an exterior surface of the upper, free end 116*b* to engage the interior surface of the outer shell 12. The projections ensure that the base 14 properly engages the outer shell 12.

Referring to FIG. 2, the container 11 further includes a cooking pot 20 positioned within and/or fixedly mounted inside the outer shell 12. The cooking pot 20 directly receives the foodstuff and the liquid to be cooked and/or heated. The cooking pot 20 has a radially outwardly extending upper open rim 20*a* and a lower closed end 20*b*. The cooking pot 20 is preferably circular or cylindrical in shape to conform to the shape of the outer shell 12 and base 14. However, the diameter of the cooking pot 20 is preferably less than that of the outer shell 12 and/or base 14. An air gap is preferably defined by and/or between the outer shell 12, the base 14 and the cooking pot 20. The heating element is preferably permanently affixed, or brazed, to an exterior surface of the lower end 20*b*. Thus, the heating element is positioned within the air gap and is positioned between the outer shell 12, the base 14 and the cooking pot 20.

The cooking pot 20 preferably includes a pour spout 22 located at and preferably extending from the upper rim 20*a*. The pour spout 22 allows the user to dispense and/or pour the liquid or cooking oil from the cooking pot 20 in a quick and convenient manner. Specifically, the pour spout 22 includes two spaced-apart, vertically-extending, sidewalls 22*a* that extend to opposite ends of a horizontally-extending base wall 22*b* that is spaced a predetermined distance from the upper rim 20*a* of the cooking pot 20. A lower portion 22*c* of the pour spout 22 forms an extension of the cooking pot 20 such that the liquid or cooking oil is guided toward an outer/upper lip 22*d* of the pour spout 22 for clean and easy pouring of the liquid. In operation, once the cooked foodstuff has been removed from the cooking pot 20, the temperature of the deep fryer 10 and liquid has cooled, and the lid 24 has been removed from the container 11, a user can manipulate and/or tilt the container 11 such that the liquid within the cooking pot 20 is poured and/or drained through the pour spout 22 to a drain or another container.

As seen in FIGS. 1 and 2, the container 11 further includes a ring 16 securely attached to the upper rim 12*a* of the outer shell 12. The ring 16 is generally circular or cylindrical in shape to conform to the generally circular or cylindrical shape of the upper surface 12*a* of the outer shell 12. The ring 16 is preferably sized and shaped to receive at least a portion of the pour spout 22 therein. Further, the ring 16 is preferably sized and shaped to be at least partially received within the cut-out 106 of the outer shell 12. Thus, the ring 16 is preferably sandwiched or secured in place between the outer shell 12 and the cooking pot 20.

As seen in FIG. 1, the lid 24 includes a generally bulbous handle 82 that extends from a top surface thereof. The lid 24 is preferably generally circular in shape when viewed from above or below to conform to the size and shape of the container 11 of the deep fryer 10. An arcuate flange or sidewall 130 orthogonally extends from the bottom surface of the lid 24 around the entire outer circumference of the lid 24. A catch or tongue 114 extends a predetermined distance beyond and/or below the flange 113. The tongue 114 is sized and shaped to at least partially enclose and/or cover the pour spout 22 of the cooking pot 20 and/or the cut-out 106 of the outer shell 12 when the lid 24 is placed on the container 11. Thus, when the lid 24 is properly positioned on the container 11, the tongue 114 aligns with the conduit pour spout 22 to help prevent hot liquid or cooking oil from inadvertently flowing out of the pour spout 22 of the cooking pot 20. The tongue 114 also provides a visual indication to the user of the proper orientation of the lid 24 onto the container 11.

Figure 3:
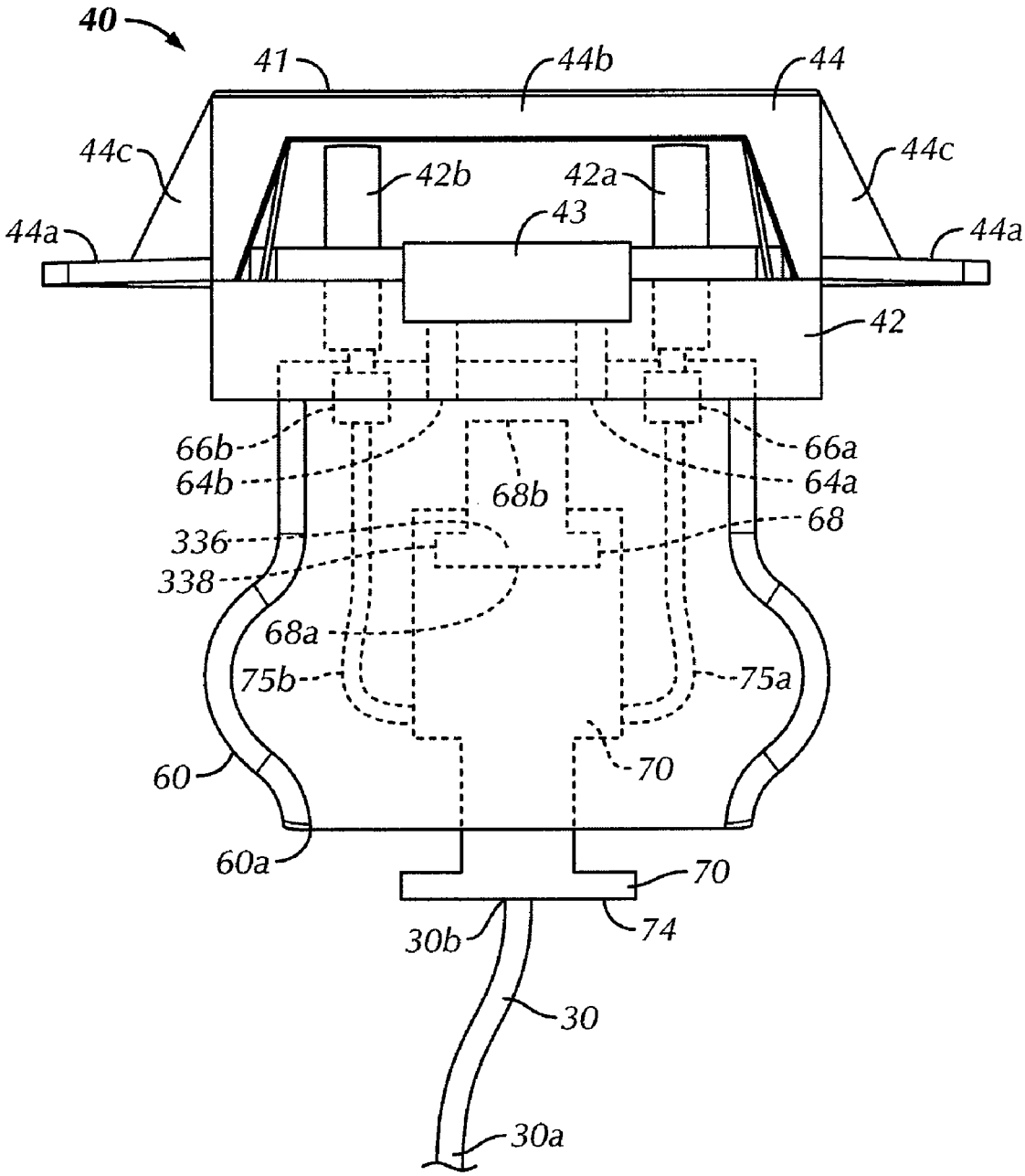
FIG. 3 is a top plan view of an electrical connector and a plug of the deep fryer shown in FIG. 1, with various internal structure of the plug shown in phantom and a magnet shown in a second or moved position.

Referring now to FIGS. 1-3, the socket 41 is preferably fixedly mounted to the outer shell 12 of the kitchen appliance 10. In the preferred embodiment, the socket 41 is recessed within the outer shell 12 such that at least a portion of the plug 60 must be inserted into an opening in the outer shell 12 to engage the socket 41. However, the socket 41 may extend outwardly from the outer shell 12 such that the plug 60 can operatively connect to the socket 41 while being spaced-apart from the exterior surface of the outer shell 12. The socket 41 includes a face plate 44 and a central bracket 42 preferably formed of a non-conductive material. The face plate 44 preferably includes a rear wall 44*d* and two spaced-apart sidewalls 44*c* at each end of the rear wall 44*d*. The sidewalls 44*c* preferably extend perpendicular to the rear wall 44*d*. The face plate 44 also includes a mounting portion 44*a* that extends perpendicularly from each sidewall 44*c*. Each mounting portion 44*a* includes an opening 44*b* (FIG. 2) therethrough, such that the face plate 44 may be fixedly attached to the internal surface of the outer shell 12 by a fastening member (not shown), such a screw, bolt or adhesive.

As seen in FIGS. 2 and 3, the bracket 42 supports the at least one, but preferably two spaced-apart electrical contacts 42*a*, 42*b* and at least one metallic member 43. The bracket 42 preferably spaces the electrical contacts 42*a*, 42*b* in a spaced-apart manner and securely mounts the at least one metallic member 43 within the socket 41 between the contacts 42*a*, 42*b*. Specifically, the two spaced-apart electrical contacts 42*a*, 42*b* extend through two spaced-apart openings (not shown) and the metallic member 43 preferably wraps around at least a portion of the bracket 42 such that it can be fixed to the bracket 42. The metallic member 43 may simply be an object formed of metal or a magnet. It is understood by those skilled in the art that the socket 41 is not limited to one metallic member 43, but may include two or more metallic members (not shown) if it is desired to increase an attractive force with the plug 60.

Figure 4:
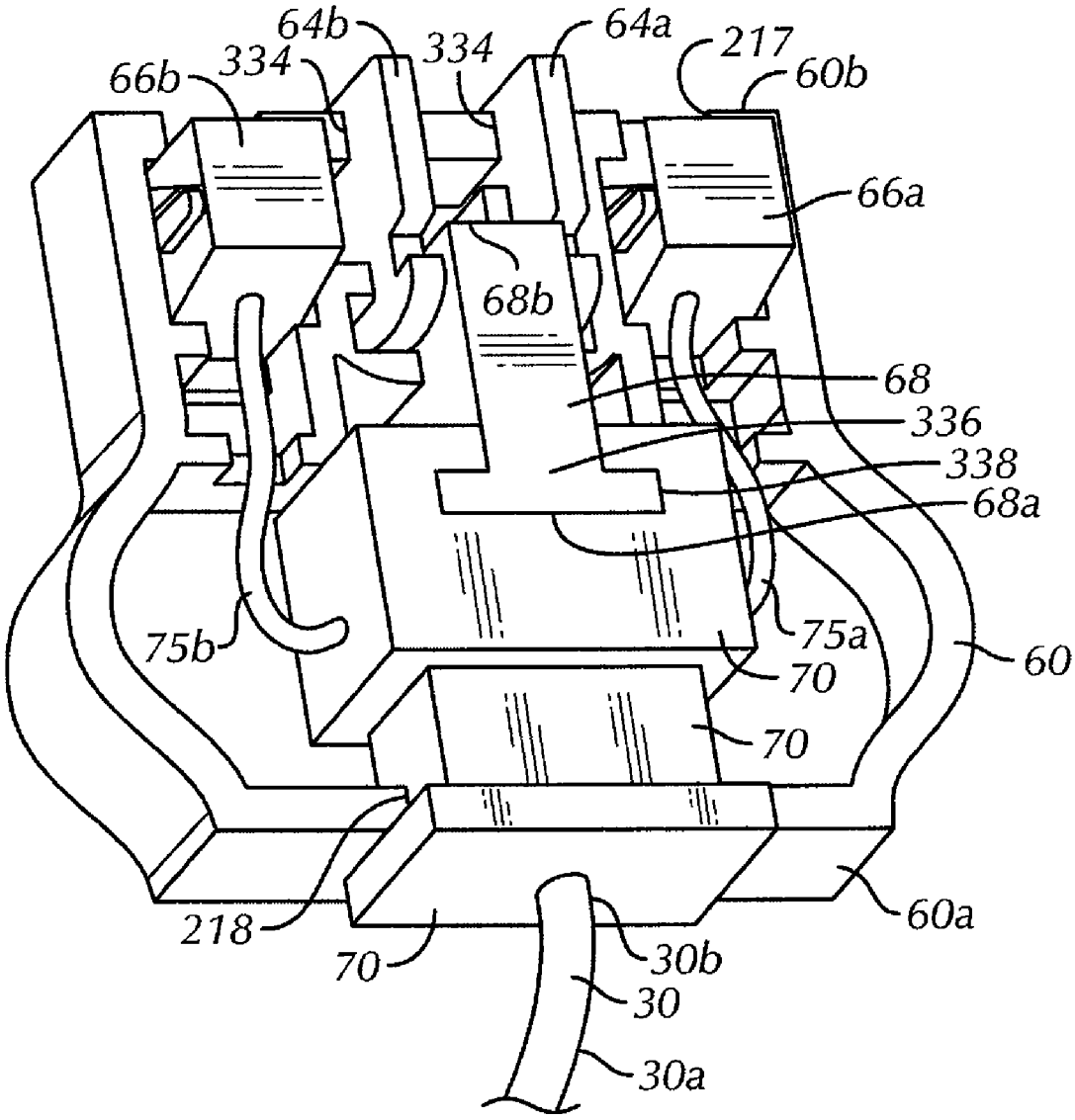
FIG. 4 is a cross-sectional perspective view of the plug of the deep fryer shown in FIG. 3, with the magnet shown in the first or original position.

In the preferred embodiment, the plug 60 is generally sized and shaped to at least partially fit within an opening 216 of the socket 41. As seen in FIG. 4, the plug 60 has a proximal end 60*b* and an opposite distal end 60*a*. Preferably, both the proximal end 60*b* and the distal end 60*a* include an opening 217, 218, respectively, therein. The proximal end 60*b* of the plug 60 has at least one electrical contact 66*a*, 66*b* for operative engagement with the at least one electrical contact 42*a*, 42*b*, of the socket 41. Preferably, the proximal end 60*b* of the plug 60 includes two spaced-apart electrical contacts 66*a*, 66*b* positioned to operatively engage the two spaced-apart electrical contacts 42*a*, 42*b* of the socket 41. Thus, it is preferred that each electrical contact 66*a*, 66*b* of the plug 60 is sized, shaped and located to engage at least a portion of one of the electrical contacts 42*a*, 42*b* of the socket 41.

Further, the proximal end 60*b* of the plug 60 preferably includes at least one metallic plate 64*a*, 64*b*, wherein at least a portion of the plate 64*a*, 64*b* extends outwardly beyond the proximal end of the plug 60. The at least one plate 64*a*, 64*b* is generally elongated in shape and is fixedly positioned within a groove 334 (FIG. 4) in the plug 60. However, in the preferred embodiment, the plug 60 includes two spaced-apart metallic plates 64*a*, 64*b* that are fixedly mounted within the plug 60. It is understood by those skilled in the art that the two plates 64*a*, 64*b* may be movably or slidably mounted within the plug 60. Further, while it is preferred that the two metallic plates 64*a*, 64*b* are located between the two spaced-apart electrical contacts 66*a*, 66*b* of the plug 60, the present invention is not limited to such an arrangement.

As shown in FIGS. 3 and 4, at least one magnet 68 is preferably movably positioned within the plug 60. When the magnet 68 is in a first or original position (FIG. 4) and the plug 60 is attached to the socket 41, a magnetic attractive force exists between the metallic member 43 of the socket 41 and the metallic plates 64*a*, 64*b* of the plug 60, which are in contact with the magnet 68 to create the break-away electrical connection that can be relatively easily disengaged to prevent the deep fryer 10 from inadvertently tipping when the plug 60 is removed from the socket 41. In the preferred embodiment, the magnet 68 includes a first end 68*b* and an opposite second end 68*a* and is generally rectangular in shape having a flange 336 proximate the second end 68*a*. Preferably, the magnet 68 is slidable with respect to the proximal and distal ends 60*b*, 60*a* of the plug 60.

Specifically, the magnet 68 is movable between the first or original position (FIG. 4) in which at least the first end 68*b* of the magnet 68 is located between or adjacent to and engaging the plates 64*a*, 64*b* and a second or moved position (FIG. 3) in which the first end 68*b* of the magnet 68 is spaced a predetermined distance from the plates 64*a*, 64*b* and/or spaced a predetermined distance from the first position (FIG. 4). In the first or original position (FIG. 4), the first end 68*b* of the magnet 68 engages the metallic plates 64*a*, 64*b* creating a magnetic force within the plates 64*a*, 64*b*. The magnetic attractive force between the magnet 68 and the plates 64*a*, 64*b* is greater than when the magnet 68 is in the first position (FIG. 4). Although the magnet 68 is preferably generally centrally located within the plug 60, the magnet 68 may be positioned virtually anywhere within the plug 60. It is understood by those skilled in the art that the plug 60 may at least partially enclose two or more magnets (not shown) to increase the attractive force between the plug 60 and the socket 41.

Referring again to FIGS. 3 and 4, the power cord 30 has a leading end 30*b* and an opposite trailing end 30*a*. The leading end 30*b* is movable with respect to the plug 60 and is operatively connected to the magnet and the at least one electrical contact 66*a*, 66*b* of the plug 60. Preferably, the leading end 30*b* of the plug 60 is connected to flexible electrical leads 75*a*, 75*b*, which are connected to the electrical contacts 66*a*, 66*b*, respectively. The trailing end 30*b* of the plug 60 is operatively engagable with the power source. In operation, the attractive force exists between the at least one metallic member 43 and the magnet 68 in its strongest state when the plug 60 is engaged with the socket 41 and the magnet 68 is in the first position. Movement of the leading end 30*b* of the power cord 30 away from the proximal end 60*b* of the plug 60 moves the magnet 68 toward the distal end of the plug 60 to reduce the magnitude of the magnetic attractive force, thus allowing the user to more easily remove the plug 60 from the socket.

As seen in FIGS. 3 and 4, the plug 60 includes at least one linking member 70 movably mounted at least partially within the plug 60. Specifically, in the preferred embodiment, the plug 60 at least partially encloses the linking member 70. At least a portion of the at least one linking member 70 is movably positioned within the opening 218 at the distal end 60*a* of the plug 60 and at least a portion of the at least one linking member 70 is fixedly attached to at least a portion of the magnet 68. Preferably, at least a portion of the at least one linking member 70 is directly connected to, but preferably surrounds, at least a portion of the magnet 68. For example, as seen in FIGS. 3 and 4, the at least one linking member 70 may include a receptacle 338 sized and shaped to receive at least a portion of the flange 336 of the at least one magnet 68. Thus, movement of the at least one linking member 70 causes the magnet 68 to move/slide therewith.

Further, the leading end 30*b* of the power cord 30 is preferably fixedly attached to at least a portion of one of the at least one linking member 70 and operatively connected to the electrical contacts 66*a*, 66*b* by the flexible electrical leads 75*a*, 75*b*, respectively. In the preferred embodiment, the leading end 30*b* of the power cord 30 is securely or fixedly attached to a rear surface of the at least one linking member 70. Therefore, when plug 60 is positioned within the socket 41 and the user pulls either the leading or trailing end 30*b*, 30*a* of the power cord 30 away from the socket 41, the leading end 30*b* pulls, moves or slides the at least one linking member 70. The movement of the at least one linking member 70 toward the distal end 60*a* of the plug 60 or away from the socket 41 causes the magnet 68 to move/slide toward the distal end of the plug 60 and/or away from the metallic plates 64*a*, 64*b*. The movement of the magnet 68 reduces the magnitude of the attractive force between the metallic plates 64*a*, 64*b* and the metallic member 43 of the socket 41 such that the user can more easily disengage the plug 60 from the socket 41 to cut power to the kitchen appliance 10.

Once the user releases the leading or trailing end 30*b*, 30*a* of the power cord 30, an attractive or magnetic force between the magnet 68 and the metallic plates 64*a*, 64*b* causes the magnet 68 to move/slide back to its original position (FIG. 4) within the plug 60. However, one or more biasing members (not shown), such as a coil or leaf spring, may be positioned within the plug 60, such as between an interior surface of the plug 60 and the at least one linking member to help urge the magnet 68 back to its original position (FIG. 4) once the force that pulls, moves or slides the magnet 68 toward the distal end 60*a* of the plug 60 is released or diminished.

It will be appreciated by those skilled in the art that changes could be made to the embodiment described above without departing from the broad inventive concept thereof. It is understood, therefore, that this invention is not limited to the particular embodiment disclosed, but is intended to cover modifications within the spirit and scope of the present invention as defined by the appended claims.

I claim:

1. An electrical connector for a kitchen appliance, the connector comprising:

a socket mounted to the kitchen appliance, the socket having at least one electrical contact and at least one metallic member;

a plug having a proximal end and an opposite distal end, the proximal end of the plug having at least one electrical contact for operative engagement with the at least one electrical contact of the socket;

a magnet movably positioned within the plug, the magnet having a first end and an opposite second end; and a power cord having a leading end and an opposite trailing end, the leading end being movable with respect to the plug and being operatively connected to the magnet and the at least one electrical contact of the plug, the trailing end being operatively engageable with an electrical outlet, wherein an attractive force exists between the at least one metallic member and the magnet when the plug is engaged with the socket and the magnet is within a predetermined distance of the at least one metallic member, and wherein movement of the leading end of the power cord away from the proximal end of the plug moves the magnet toward the distal end of the plug to reduce a magnitude of the attractive force and permit the plug to be more easily removed from the socket.

2. The electrical connector according to claim 1, wherein the magnet is slidable with respect to the proximal and distal ends of the plug.

3. The electrical connector according to claim 2, further including at least one linking member movably mounted within the plug, wherein at least a portion of the at least one linking member is fixedly attached to at least a portion of the magnet.

4. The electrical connector according to claim 3, wherein at least a portion of the at least one linking member is connected to at least a portion of the magnet.

5. The electrical connector according to claim 4, wherein the power cord is fixedly attached to at least a portion of the at least one linking member.

6. The electrical connector according to claim 5, wherein the distal end of the plug includes an opening and wherein at least a portion of the at least one linking member is movably positioned within the opening.

7. The electrical connector according to claim 3, wherein the at least one linking member surrounds at least a portion of the magnet.

8. The electrical connector according to claim 4, wherein the at least one linking member includes a receptacle sized and shaped to receive at least a portion of a flange of the magnet.

9. The electrical connector according to claim 1, wherein the proximal end of the plug includes at least one metallic plate, wherein at least a portion of the at least one plate extends outwardly beyond the proximal end of the plug.

10. The electrical connector according to claim 9, wherein the magnet is movable between a first position in which at least the first end of the magnet is adjacent the at least one plate and a second position in which the first end of the magnet is spaced a predetermined distance from the at least one plate.

11. The electrical connector according to claim 9, wherein the proximal end of the plug includes two spaced-apart metallic plates, at least a portion of each plate extending outwardly beyond the proximal end of the plug.

12. The electrical connector according to claim 11, wherein the two plates are fixedly mounted within the plug.

13. The electrical connector according to claim 11, wherein the proximal end of the plug includes two spaced-apart electrical contacts and the socket includes two spaced-apart electrical contacts, each electrical contact of the plug being sized and shaped to engage at least a portion of one of the electrical contacts of the socket.

14. The electrical connector according to claim 13, wherein the two metallic plates are located between the two-spaced apart electrical contacts of the plug.

15. The electrical connector according to claim 1, wherein the kitchen appliance is a deep fryer.

16. The electrical connector according to claim 1, further comprising:

a flexible electrical lead operatively connecting the leading end of the power cord to each of the electrical contacts within the plug.

* * * * *